United States Patent [19]

Cimino

[11] Patent Number: 4,807,882

[45] Date of Patent: Feb. 28, 1989

[54] RANDOM NUMERAL SELECTING DEVICE

[76] Inventor: Robert Cimino, 3115 Feasler Ave., Erie, Pa. 16506

[21] Appl. No.: 926,081

[22] Filed: Nov. 3, 1986

[51] Int. Cl.[4] ..... A63B 71/00

[52] U.S. Cl. ..... 273/144 B; 273/145 C; 273/138 R

[58] Field of Search ..... 273/144 B, 144 R, 138 R, 273/145 C, 145 R, 115

[56] References Cited

U.S. PATENT DOCUMENTS

| | | | |
|---|---|---|---|
| 2,532,116 | 11/1950 | Monaco | 273/115 |
| 3,304,091 | 2/1967 | Bittner | 273/144 B |
| 3,508,755 | 4/1970 | Johnson | 273/145 C |
| 4,465,278 | 8/1984 | Messina | 273/144 B |
| 4,509,755 | 4/1985 | Cheatham | 273/144 B |
| 4,545,578 | 10/1985 | Stagg | 273/144 B |

FOREIGN PATENT DOCUMENTS

| | | | |
|---|---|---|---|
| 646271 | 10/1934 | Fed. Rep. of Germany | 273/94 |
| 743309 | 1/1956 | United Kingdom | 273/144 B |
| 897402 | 5/1962 | United Kingdom | 273/144 B |

*Primary Examiner*—Richard C. Pinkham
*Assistant Examiner*—Mark S. Graham
*Attorney, Agent, or Firm*—Charles L. Lovercheck; Wayne L. Lovercheck; Dale R. Lovercheck

[57] ABSTRACT

A random number selector is disclosed having a body generally in the form of a plate having three axially extending vertically spaced rectangular chambers formed in it. The three chambers are spaced from one another by a top generally rectangular part, two spaced intermediate parts and a bottom rectangular part, third rectangular parts extending from one side to the other. End parts closing the three chambers. The top of each rectangular part forming a shelf having half cylindrical shaped recesses. The recesses are adjacent one another so that the half cylindrical parts each engage the adjacent part so that the edge of each chamber has a sharp top edge. A transparent cover is supported over the front of the body and six red balls are received in the top chamber, four yellow balls in the intermediate chamber and three green balls in the lower chamber. A wedge shaped bead overlies the recesses and prevents the balls from rolling out when the selector is tilted back.

2 Claims, 1 Drawing Sheet

RANDOM NUMERAL SELECTING DEVICE

BACKGROUND OF THE INVENTION

This invention relates to devices for randomly selecting numbers and more particularly to an improved device which will select at random three-digit numbers, four-digit numbers and six-digit numbers.

REFERENCE TO PRIOR ART

Mechanical numeral selecting devices for randomly selecting numbers are known. Some of these devices of which applicant is aware are shown in U.S. Pat. No. 3,304,091 to Bittner; U.S. Pat. No. 4,465,278 to Messina et al; U.S. Pat. No. 4,545,578 to Stagg, Jr. None of these prior devices are substantially purely random in selection of three-, four- and six-digit numbers. Applicant has provided an improvement in these prior devices.

STATEMENT OF THE INVENTION

The random number selecting device disclosed herein is suitable for selecting either three, four or six-digit numbers in a substantially purely random fashion. The device has three chambers, each containing balls of a different color from the other two chambers, for example, one chamber contains red balls, another yellow balls and another green balls. The six-digit number chamber contains six red balls, for example; the four-digit number chamber contains four yellow balls, for example, and the three-digit number chamber contains three green balls, for example. The top row which is the six-digit chamber has forty recesses of scrambled numbers from 1 to 40. This will give any possible combination of numbers from 1 to 40. The middle row has four sets of scrambled numbers, each set containing numerals from 0 to 9. The middle row gives any combination of numbers from 0000 to 9999. This is used to select the four-digit number. The bottom row has three sets of scrambled numbers, each set containing numerals from 0 to 9. This arrangement will indicate a selection of any combination of numbers from 000 to 999. This is used to select the three-digit number.

In use, the balls in all the chambers are mixed up and come to rest in the recesses corresponding to the scrambled numbers to simulate the mixing action used by the state when picking numbers out of a bingo cage, etc. This feature eliminates the repeated selection of numbers coming up in a rotation sequence such as, for example, 17-18-19-20, 1-2-3-4, etc. This improves the chances of selecting numbers at random as is done with the bingo cages, etc. Since it is well known that the numbers picked in this manner do not come up in a repeated rotation sequence, as mentioned above, for example, 17-18-19-20, etc. Numbers picked at random from a bingo cage or any other known random method usually come out mixed up or in different combinations. This is what the present invention is intended to do.

DETAILED DESCRIPTION OF THE DRAWINGS

Figure 1:
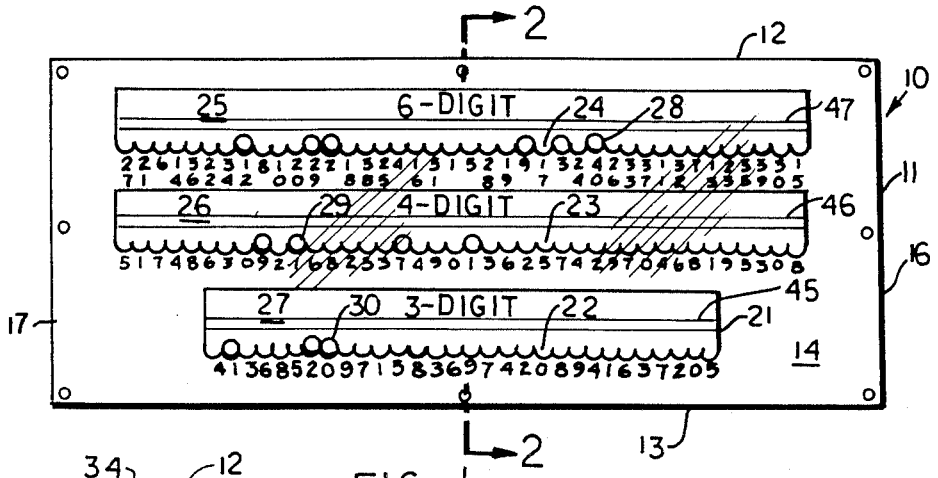
FIG. 1 is a front view of the random numeral selecting device according to the invention.
Figure 2:
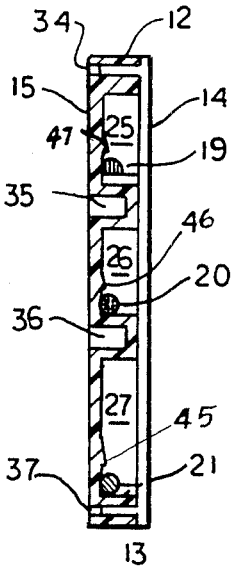
FIG. 2 is a cross sectional view taken on line 2—2 of FIG. 1.
Figure 3:
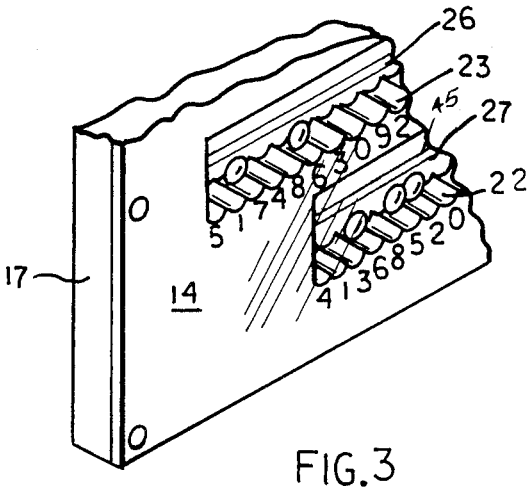
FIG. 3 is an enlarged partial isometric view of a part of one end of the device.
Figure 4:
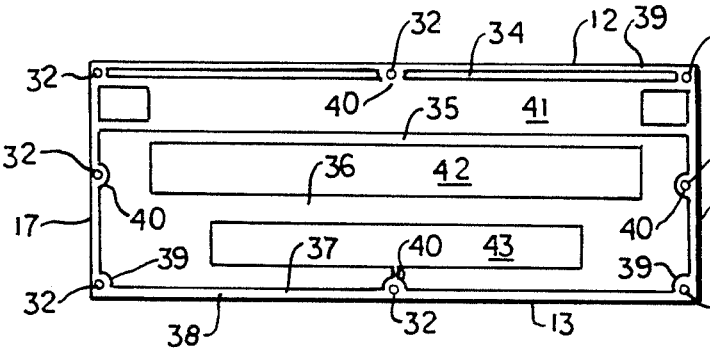
FIG. 4 is a rear view of the device.
Figures 5, 6:
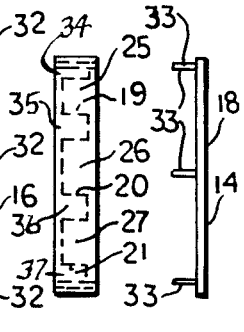
FIG. 5 is an end view of FIG. 4.
FIG. 6 is an end view of the cover of the device.

Now with more particular reference to the drawings, I show a random numeral selecting device 10 comprising an enclosed container 11 having a top 12, bottom 13, front 14, back 15 and sides 16 and 17. The container 11 may be molded from thermoplastic as an integral part with three chambers 25, 26 and 27. The body extends outwardly beyond the ends of the chambers 25, 26 and 27 to provide a space that can be utilized to make a device with chambers having additional length, merely by removing inserts from the injection molding die, thereby elongating the chambers 25, 26 and 27 in accordance with a technique familiar to those skilled in the art.

The front 14 may be covered with a transparent cover 18 so that balls 28, 29 and 30 in the chambers 25, 26 and 27 are confined in the three chambers respectively.

The interior of container 11 is separated into three chambers 25, 26 and 27 by first shelf 19, second shelf 20 and bottom shelf 21. Bottom shelf 21 is made up of the bottom part of container 11. Each shelf has half cylindrical shaped recesses formed in it. These recesses, forming the top surface of the bottom shelf, are numbered in accordance with a particular arrangement to accomplish the random selection feature of the invention. That is, three sets of chambers with numbered recesses. Upper ball chamber 25 contains six red balls 28, middle ball chamber 26 contains four yellow balls 29 and lower ball chamber 27 contains three green balls 30. Each ball is randomly received in one of the recesses 22, 23 and 24, after the device is shaken.

Top shelf 19 has forty recesses 24, each of which is numbered at random from one to forty; these are used to select a six-digit number. Second shelf 20 has forty recesses 23 numbered at random with numerals from zero to nine. Bottom shelf 21 has thirty recesses 22 numbered at random with numerals from zero to nine. The third chamber will give any combination of numbers at random from 000 to 999. This is used to select a three-digit number. Each recess is in the form of a half cylinder. The recesses are closed at one end by the back 15. The back 15 has a bead 45 at the rear of the bottom shelf, bead 46 at the rear of the second shelf and a bead 47 at the rear end of the top shelf. These beads, 45, 46 and 47 are wedge shaped in cross section and overlie the rear end of each recess and extend along the back, above each recess so that when the device is rested on its back, with face up, and inclined upward and away from the operator, the balls will be retained from rolling out of the recesses by the beads.

Holes 32 are molded in container 11. Holes 32 receive pins 33 which are molded integrally with transparent cover 18.

Container 11 has grooves 34, 35, 36 and 37 molded in its back for reducing the amount of material used to mold the container and to reduce its weight. Grooves 34, 35, 36 and 37 are defined by outer marginal flange 38 with bosses 39 at each corner and intermediate bosses 40. Bosses 41, 42 and 43 are disposed behind recesses defining chambers 25, 26 and 27 respectively.

The device disclosed herein may be made of thermoplastic or injection molded. It can be made of two pieces, the body and the cover. When viewed from the front, three chambers 25, 26 and 27 are visible, separated by shelves 19, 20 and 21.

The foregoing specification sets forth the invention in its preferred, practical forms but the structure shown is capable of modification within a range of equivalents without departing from the invention which is to be understood is broadly novel as is commensurate with the appended claims.

What is claimed is:

1. A random numeral selecting device comprising, an enclosed body having a top, bottom, front, back and ends forming a closed container, a first shelf, a second shelf, a third shelf, said shelves being spaced from one another generally parallel to one another and defining an upper chamber, a middle chamber and a bottom chamber, a transparent cover over said chambers, said shelves each having a plurality of adjoining recesses, half cylindrical in shape forming an upper edge on each said shelf, said first shelf having forty said recesses, said second shelf having forty said recesses, said third shelf having thirty said recesses, said recesses in said first shelf being randomly numbered with a number taken from a group of from one to forty, said recesses in said second shelf being numbered with scrambled numbers in four sequences from zero to nine, said recesses in said third shelf being randomly numbered in three sequences from zero to nine, six balls being disposed in said upper chamber, four balls being disposed in said middle chamber, three balls being disposed in said bottom chamber, said upper chamber being adapted to have six balls rest in six of said recesses to designate a combination of any six of said numbers from 1 to 40, said middle chamber being adapted to have said four balls rest in four said recesses to designate combinations of numbers from 0000 to 9999 of said group of numbers, said bottom chamber being adapted to have said three balls rest in three said recesses to designate numbers from 000 to 999, some of said recesses in said top chamber having two numbers below them indicating a two digit number, each said recess being closed at its rear end by a back, a bead wedge shaped in cross section being formed on said back and extending from one end of said chamber to the other, said wedge shaped bead having a larger side and a smaller side, said larger side of said bead being disposed downward, said large side of said bead overlying a part of said recesses preventing said balls from rolling out of said recesses when said device rests on its back and it tilted away from said bottom of said recesses.

2. The device recited in claim 1 wherein said balls in said upper chamber are red, said balls in said middle chamber are yellow, said balls in said bottom chamber are green.

* * * * *